US011639007B2

(12) United States Patent
Habben et al.

(10) Patent No.: US 11,639,007 B2
(45) Date of Patent: May 2, 2023

(54) APPARATUS FOR RELEASABLY LOCKING A STATIONARY BLADE TO A HAIR CLIPPER

(71) Applicant: WAHL CLIPPER CORPORATION, Sterling, IL (US)

(72) Inventors: Rick Habben, Sterling, IL (US); Justin Shang, Geneva, IL (US); Jeffrey S. Bouray, Thomson, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 0 days.

(21) Appl. No.: 16/857,860

(22) Filed: Apr. 24, 2020

(65) Prior Publication Data

US 2021/0046664 A1 Feb. 18, 2021

Related U.S. Application Data

(60) Provisional application No. 62/887,222, filed on Aug. 15, 2019.

(51) Int. Cl.
*B26B 19/38* (2006.01)
*B26B 19/06* (2006.01)

(52) U.S. Cl.
CPC ..... *B26B 19/3853* (2013.01); *B26B 19/3846* (2013.01); *B26B 19/06* (2013.01)

(58) Field of Classification Search
CPC ... B26B 19/06; B26B 19/205; B26B 19/3846; B26B 19/3853
USPC ..... 30/458, 51, 68, 69; 144/28.6
See application file for complete search history.

(56) References Cited

U.S. PATENT DOCUMENTS 980,593 A * 1/1911 Brunacci ..... B26B 21/18 30/68
1,059,487 A * 4/1913 Rich ..... B26B 21/16 30/51
1,064,457 A * 6/1913 Dunn ..... B26B 21/18 30/68
1,116,448 A * 11/1914 Lawson ..... B26B 21/18 30/68
1,296,080 A * 3/1919 Holt ..... B26B 21/18 30/68
1,342,096 A * 6/1920 Carlsen ..... B26B 19/066 30/213
1,527,322 A * 2/1925 Masotti ..... B26B 19/066 30/200
1,586,924 A * 6/1926 Undeland ..... B26B 19/066 30/223
1,729,096 A * 9/1929 Dean ..... B26B 19/066 30/213

(Continued)

FOREIGN PATENT DOCUMENTS

GB 1101068 A * 1/1968 ..... B26B 19/06

*Primary Examiner* — Jonathan G Riley
(74) *Attorney, Agent, or Firm* — Greer, Burns & Crain, Ltd

(57) ABSTRACT

An apparatus is provided for releasably locking a stationary blade to a hair clipper, and includes a stationary blade with a blade opening, and a bracket configured for fixing the stationary blade to the hair clipper. Also, the bracket has a bracket opening. An actuator in the apparatus has a locking formation engageable in the openings and is operable between a first, locked position locking the stationary blade to the bracket, and a second, unlocked position releasing the stationary blade from the bracket.

18 Claims, 11 Drawing Sheets

(56) References Cited

U.S. PATENT DOCUMENTS 1,749,543 A * 3/1930 Oster ..... B26B 19/066 30/213
1,794,410 A * 3/1931 Kocourek ..... B26B 19/06 24/522
1,821,072 A * 9/1931 Parry ..... B26B 21/18 30/68
1,861,617 A * 6/1932 Wahl ..... B26B 19/066 30/201
1,914,243 A * 6/1933 Dean ..... B26B 19/066 30/209
2,210,767 A * 8/1940 McGown ..... B26B 21/18 30/68
2,367,571 A * 1/1945 Gaide ..... B26B 21/14 30/41
2,372,100 A * 3/1945 McWatters ..... B26B 21/18 30/68
2,659,968 A * 12/1950 Weeks ..... B26B 21/16 30/51
2,720,695 A * 11/1953 Crisp ..... B26B 21/38 30/45
2,721,697 A * 10/1955 Gilpin ..... G06C 23/02 235/62 A
2,819,519 A * 1/1958 Isroff ..... B26B 21/32 30/526
2,860,412 A * 11/1958 Andis ..... B26B 19/06 30/200
3,280,456 A * 10/1966 Erickson et al. ..... B26B 19/44 30/133
4,989,324 A * 2/1991 Andis ..... B26B 19/06 30/221
5,575,069 A * 11/1996 Roberto Kneeland ..... B26B 19/06 30/199
5,933,964 A 8/1999 Altamore
8,276,279 B2 10/2012 Heckman et al.
8,806,757 B2 8/2014 Moseman
D715,490 S 10/2014 Aulwes et al.
9,545,729 B2 1/2017 Buck, Jr. et al.
10,272,578 B2 4/2019 Johnson
11,267,146 B2 * 3/2022 Kruse ..... B26B 19/205
2020/0009752 A1 * 1/2020 Iaccarino ..... B26B 19/3853

* cited by examiner

APPARATUS FOR RELEASABLY LOCKING A STATIONARY BLADE TO A HAIR CLIPPER

RELATED APPLICATION

The present application claims the benefit under 35 U.S.C. § 119(e) of U.S. patent application Ser. No. 62/887,222 filed on Aug. 15, 2019, the entire contents of which are incorporated by reference herein.

BACKGROUND

The present invention relates generally to hair clippers and hair trimmers, and more specifically to devices designed for enhancing the maintenance, cleaning and/or adjustment of clipper and trimmer bladesets.

Electric hair clippers and trimmers, collectively referred to here as clippers, conventionally use a removable bladeset including a stationary blade and a moving blade, which reciprocates laterally relative to the stationary blade. Hair which is caught between respective teeth of the moving and stationary blades is clipped as the moving blade teeth move past the stationary blade teeth under the power of an internal electric motor. For barbers and other professional hair stylists, collectively referred to as hair stylists, who use electric clippers, changes in the orientation of the tips of the moving blade relative to the fixed blade are known to provide different hair styling effects. Typically, the main effect of the blade position is to alter the cut length of the subject's hair. Another such effect is providing a sharp outline of the subject's hair relative to their neck, and also to provide geometric designs cut into the subject's hair. As such, hair stylists often have designated hair clippers which are intended to provide specific styling effects and have bladesets that are pre-adjusted.

Many types of conventional hair clippers are provided with blade mounting brackets having locating bushings which are adjustable by the hair stylist to achieve the desired stationary/moving blade tip spacing. Such locating bushings are conventionally held in place by threaded fasteners.

Other types of hair clippers are provided with an adjustment lever used to move the stationary blade relative to the moving blade as an alternate mechanism for providing the above-listed styling effects. Such adjustment levers allow the stylist to adjust the clipper as needed to achieve desired effects at the time of the styling operation. More specifically, one desired styling effect is to "taper" or "blend" the length of hair to effect the quality of the resulting hair style.

Another design criterion of hair clippers is that the bladesets need to be periodically removed from the hair clipper body for cleaning and/or maintenance. In most conventional clipper bladesets, this operation is accomplished by loosening and removing a threaded fastener that secures the bladeset to a bracket on the hair clipper. Depending on the hair clipper design, this removal of the bladeset may or may not require readjustment of the relative spacing of the blades during operation. Regardless, the bladeset removal operation is considered laborious by many hair stylists.

Thus, there is a need for an improved mechanism for removing hair clipper bladesets for cleaning and/or maintenance. There is also a need for an improved mechanism for removing hair clipper bladesets that preserves the pre-adjusted relationship of the moving blade to the stationary blade.

SUMMARY

The above-listed needs are met or exceeded by the present apparatus for releasably locking a stationary blade to a hair clipper. A feature of the present apparatus is that the user can remove the stationary blade from the hair clipper without the use of tools. In addition, the fine adjustment of the stationary blade that has been set by the user prior to blade replacement is retained using the present apparatus. Thus, the operator easily removes the stationary blade for cleaning while retaining the pre-adjusted blade setting or the alignment between corresponding teeth of the stationary and the moving blade.

In the present apparatus, the removal of the stationary blade is achieved using a lever associated with a bracket used to retain the stationary blade to the clipper housing. At a pivot end, the lever is provided with a barrel and cam formation that preferably projects generally perpendicular to a longitudinal axis of an arm of the lever. The barrel and cam formation pass through a blade opening in the stationary blade, and also through a bracket opening in the bracket.

Preferably, the cam formation is constructed and arranged to engage the blade opening, and the cam has a lobe configured for passing through the bracket opening. The cam lobe has an oblong, irregular or non-circular shape, so that rotation of the arm causes the cam lobe to move between an unlocked position, in which the stationary blade is released from the clipper, and a locked position, in which the stationary blade is operatively retained on the clipper through engagement of the lobe with the bracket opening. It is also preferable that the bracket opening is non-circular, irregular and is generally complementary to the shape of the cam lobe.

To remove a locked stationary blade from the hair clipper, the user moves the lever from a first position to a second position, which rotates the position of the cam lobe relative to the bracket opening. Another feature of the present apparatus is that the lever arm is provided on a free end of the lever arm with a generally perpendicular stop. In use, a first side of the stop engages the bracket in the first or locked position, and a second, opposite side of the stop engages the bracket in the unlocked position. In other words, an entire operational stroke of the lever from one position to the other, opposite position, results in either locking or unlocking the cam lobe from the bracket opening, depending on the direction of movement of the lever.

Another feature of the present apparatus is that the lever includes a lobe axis which extends through opposed ends of the lobe, and an arm axis which extends through the free end and the pivot end of said arm. The lobe axis is inclined by an angle $\alpha$ relative to the arm axis. In an embodiment, the angle $\alpha$ is oblique. In another embodiment, the angle $\alpha$ is 45 degrees. In an embodiment, the barrel has a wave washer circumscribing an exterior of the barrel.

Another feature of the present apparatus is a securing mechanism extending through the lever proximate the pivot end for attaching the barrel and the cam to the arm.

Yet another feature of the present apparatus is that the lobe further includes a first opposed surface and a second opposed surface. The first opposed surface is closer to the arm than the second opposed surface. Opposing rounded corners are provided on the first surface, such that when the lever is rotated from the second, unlocked position to the first, locked position, the rounded corners slide along chamfered edges of the bracket opening.

In an embodiment, the barrel engages the arm at the pivot end, and the barrel and the pivot end are configured to be attached to each other using a keyed structure so that an axis of the lobe extends at a predetermined angle to an axis of the arm.

More specifically, an apparatus is provided for releasably locking a stationary blade to a hair clipper, and includes a stationary blade with a blade opening, and a bracket configured for fixing the stationary blade to the hair clipper. Also, the bracket has a bracket opening. An actuator in the apparatus has a locking formation engageable in the openings and is operable between a first, locked position locking the stationary blade to the bracket, and a second, unlocked position releasing the stationary blade from the bracket.

In another embodiment, an apparatus is provided for releasably locking a stationary blade to a hair clipper. The apparatus includes a stationary blade with a blade opening, a bracket configured for fixing the stationary blade to hair clipper, the bracket having a bracket opening, and an actuator having a locking formation engageable in the openings and operable between a first, locked position locking the stationary blade to the bracket, and a second, unlocked position releasing the stationary blade from the bracket.

The actuator is a lever including an arm with a free end and a pivot end, a barrel proximate the pivot end extending from the arm, having an outer periphery, and a stop having opposed sides, proximate the free end and extending from the arm. One of the opposed sides of the stop is in contact with the bracket when the lever is in either the first, locked position or the second, unlocked position, and another of the opposed sides is in contact with the bracket when the lever is in the other of the first, locked position or the second, unlocked position.

DETAILED DESCRIPTION

Figure 1:
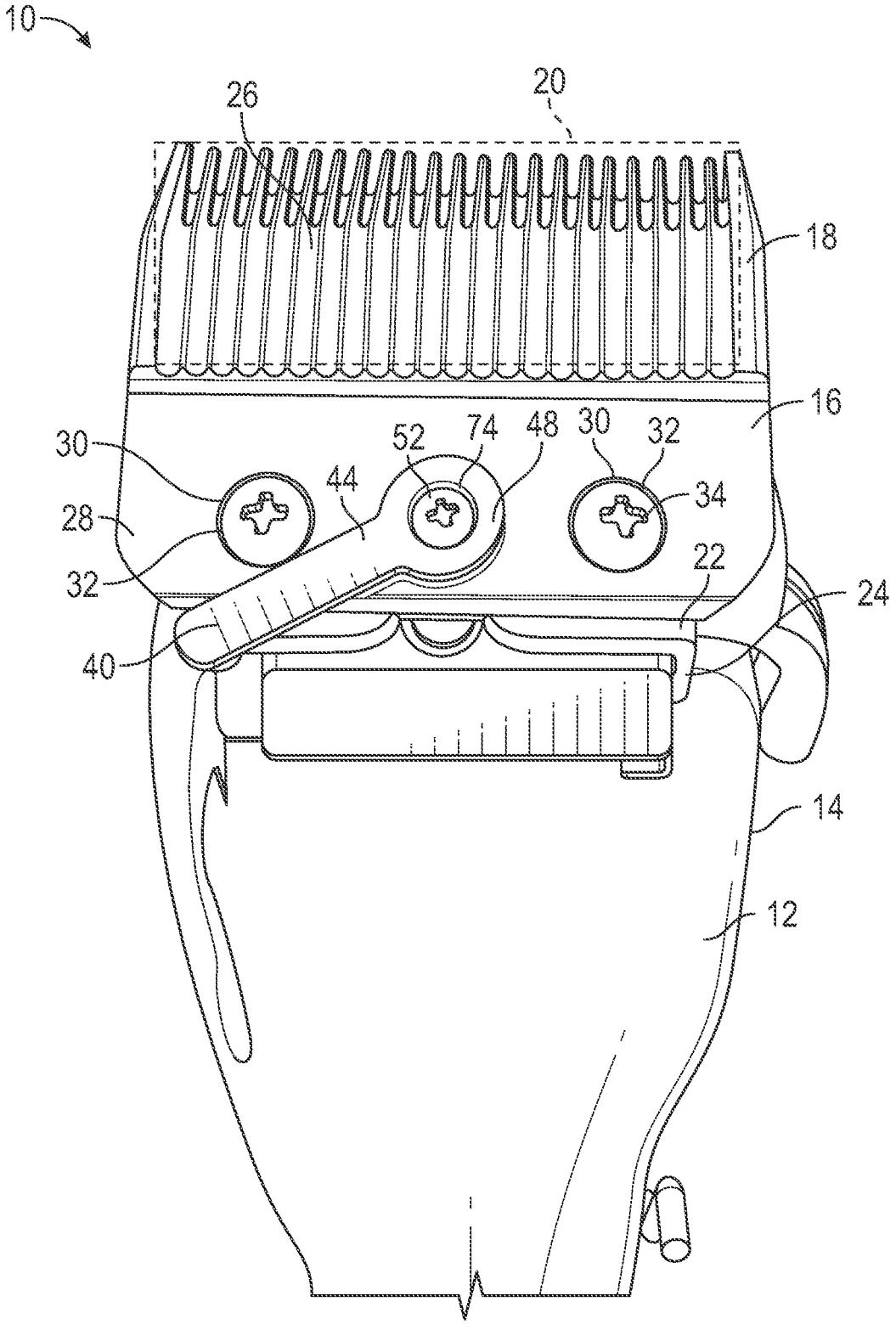
FIG. 1 is a fragmentary bottom view of a hair clipper equipped with the present apparatus for releasably locking the stationary blade to the hair clipper.
Figure 2B:
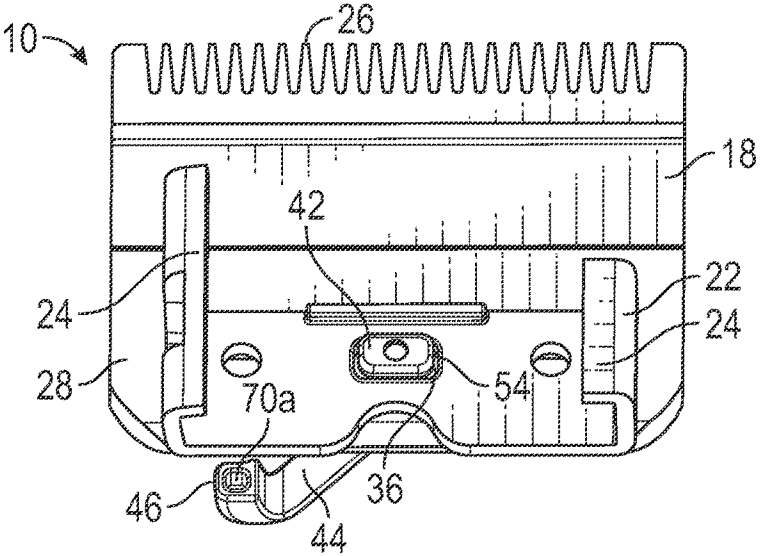
FIG. 2B is a bottom plan view of the stationary blade of FIG. 2A.
Figure 2D:
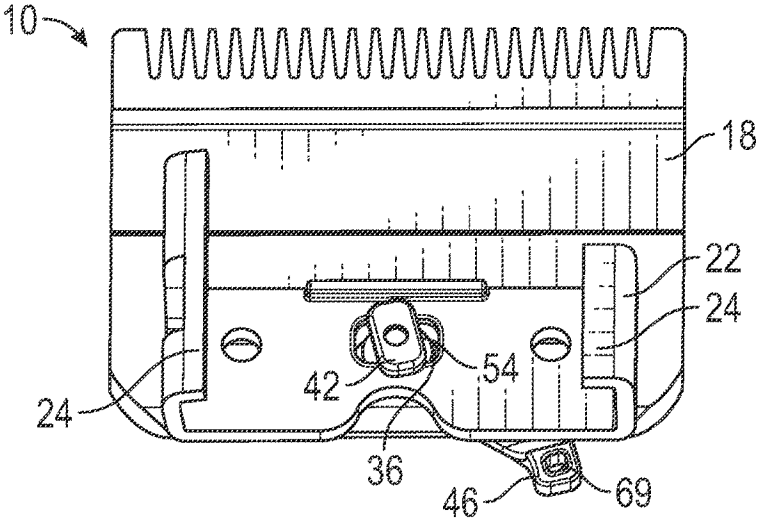
FIG. 2D is a bottom plan view of the stationary blade of FIG. 2C.
Figure 2A:
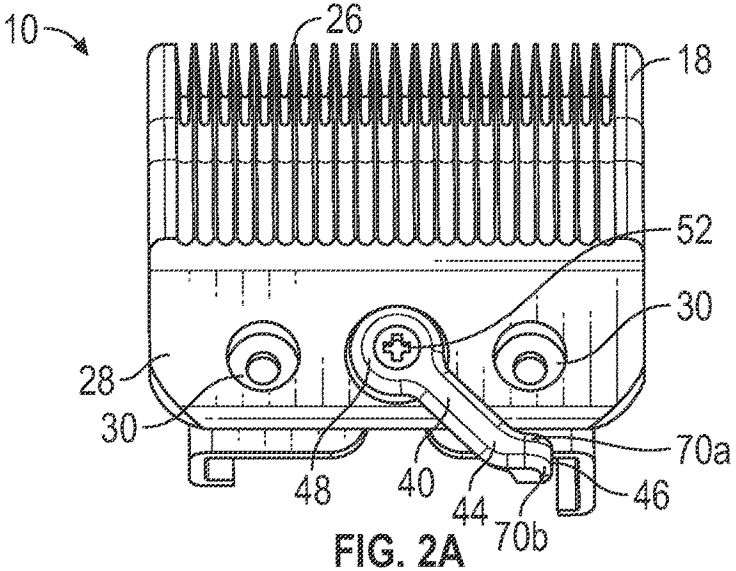
FIG. 2A is a top plan view of the stationary blade with the present apparatus in the unlocked position.
Figure 2C:
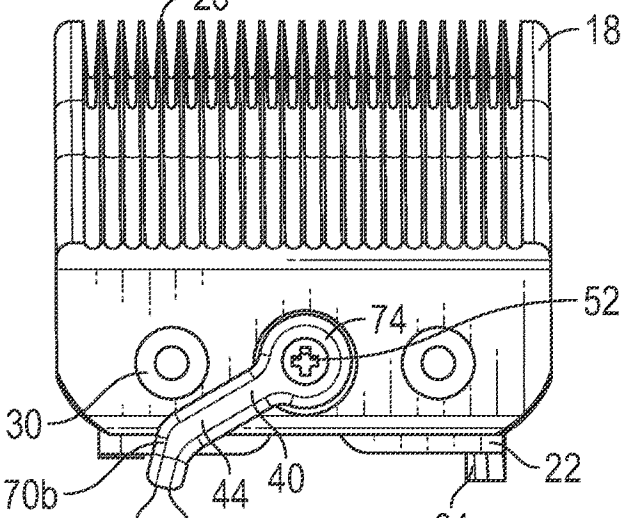
FIG. 2C is a top plan view of the stationary blade with the present apparatus in the locked position.
Figure 3:
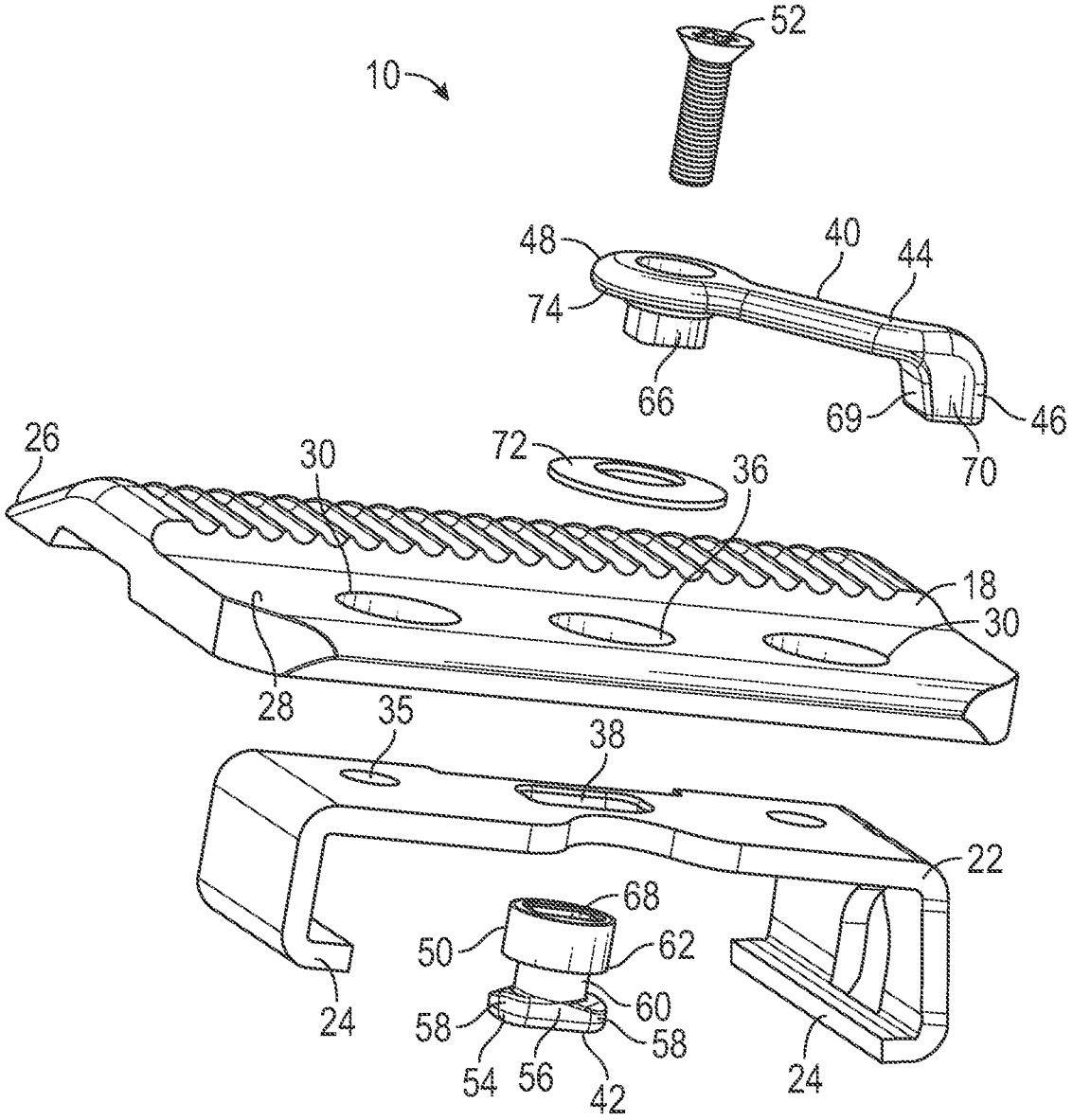
FIG. 3 is an exploded perspective view of the present apparatus.
Figure 4:
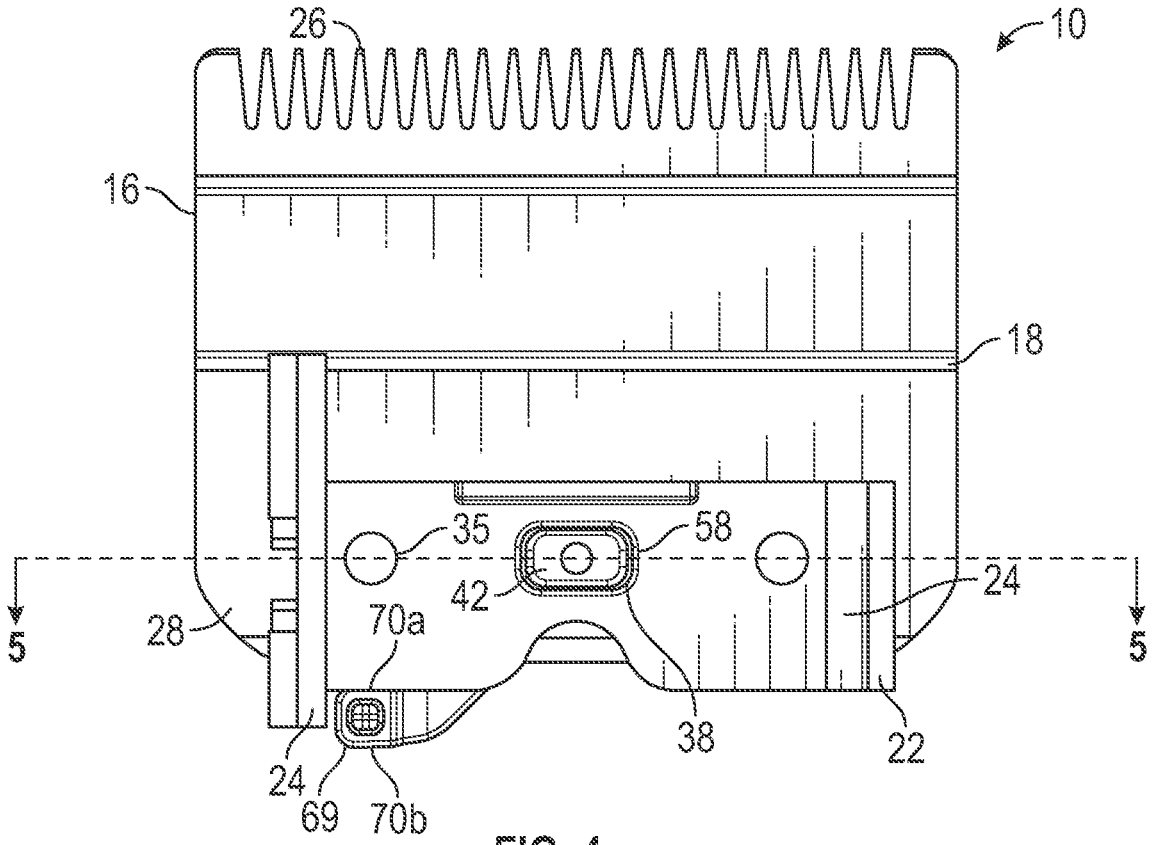
FIG. 4 is a bottom plan view of the stationary blade equipped with the present apparatus in the unlocked position.

Referring now to FIGS. 1-3, the present apparatus for locking a stationary blade to a hair clipper is generally designated 10, and is shown mounted on a conventional hair clipper 12, more specifically on a hair clipper housing 14. As is well known in the art, the hair clipper 12 is equipped with a bladeset 16 featuring a stationary blade 18 and a laterally reciprocating moving blade 20 (FIG. 1 shown hidden).

The bladeset 16 is secured to the housing 14 using a bladeset bracket 22. The bracket 22 is generally "U"-shaped when viewed from the rear as seen in FIG. 1. Such brackets 22 are slidably engaged on the housing 14, with edges 24 engaged in grooves (not shown) on the housing. On the stationary blade 18 is found a plurality of blade teeth 26 at one end, and at an opposite end, a blade base 28 having two bushing apertures 30 which are each dimensioned to accommodate a generally cylindrical bushing 32. A bushing fastener 34 is provided for securing the generally tubular bushings 32 to the blade set bracket 22, engaging mounting bores 35 (FIG. 3). Once the bushing fastener 34 is engaged through the bushing 32 and is threaded into the bracket 22, fine adjustments to the position of the stationary blade 18 are made by the user relative to the moving blade 20.

Between the bushing apertures 30 is a bracket opening 36 which is aligned with a main opening 38 in the bladeset bracket 22. In conventional hair clippers, a threaded fastener is used to fasten the stationary blade 18 to the bracket 22 through the main opening 38 and the bracket opening 36. An important feature of the present apparatus 10 is that the conventional fastener is replaced with an actuator 40, in the present embodiment taking the form of a lever having a locking formation 42 engageable in the bracket opening 36 and the main opening 38 and operable between a first, locked position (FIGS. 2C, 2D locking the stationary blade 18 to the bladeset bracket 22, and a second, unlocked position (FIGS. 2A, 2B) releasing the stationary blade from the bracket. In the preferred embodiment, the lever 40 is constructed and arranged so that a full operational stroke of the lever from the first position to the second position is also the full limit of travel of the lever relative to the bracket 22.

Referring now to FIGS. 3, 7 and 8-10, the lever 40 includes an arm 44 having a free end 46 and an opposite pivot end 48. A barrel 50 is proximate the pivot end 48 and is preferably coaxially attached to the pivot end, preferably using a threaded barrel fastener 52. The locking formation 42 takes the form of a cam located proximate to the barrel 50, and includes a lobe 54 with an outer periphery 56 having opposing ends 58. In the preferred embodiment, the lobe 54 is non-circular, oblong, parabolic or oval in shape, and it is contemplated that the shape may vary to suit the application.

Figure 5:
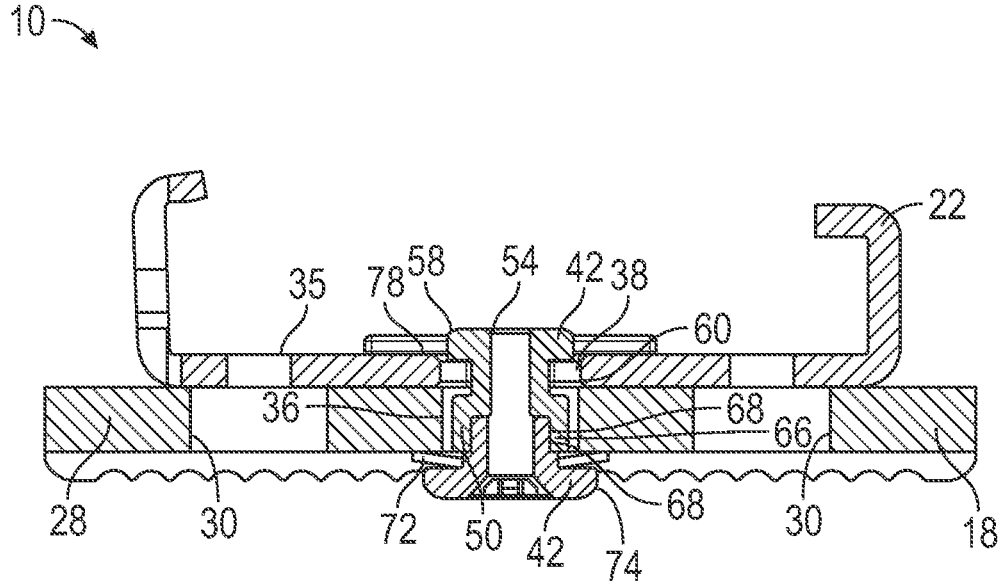
FIG. 5 is a section taken along the line 5-5 of FIG. 4 and in the direction indicated generally.
Figure 6:
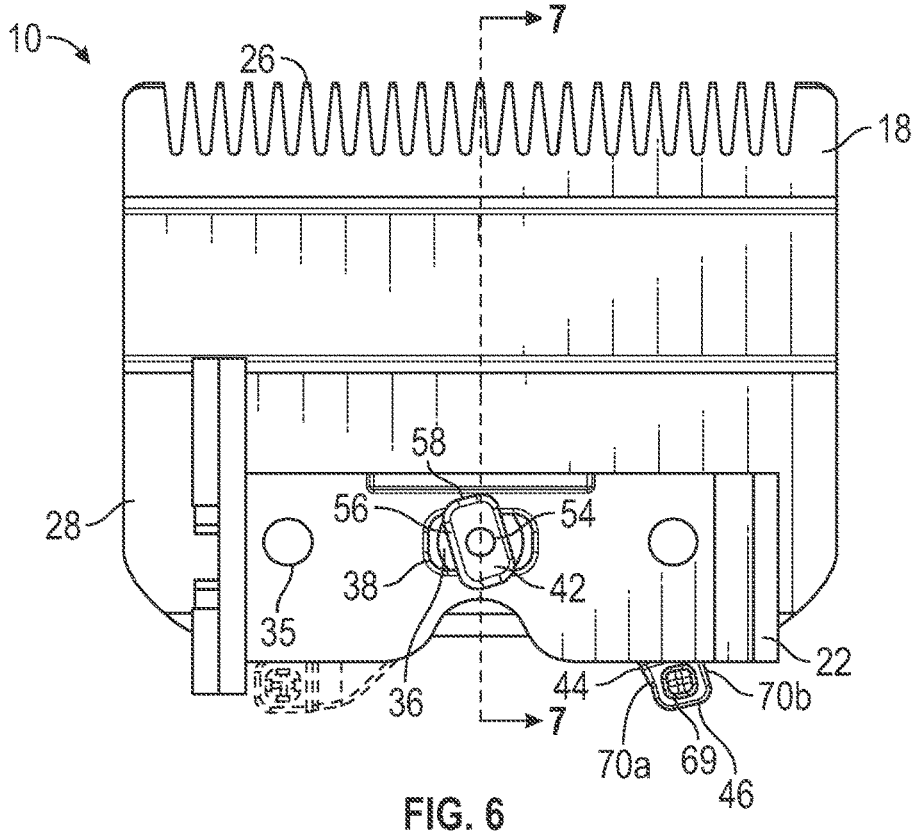
FIG. 6 is a bottom plan view of the stationary blade equipped with the present apparatus in the locked position.

A relatively narrow diameter neck 60 connects the locking formation 42 to an adjacent end 62 of the barrel 50. When viewed from a side, the locking formation 42 and the neck combine to form a "T"-shape. Compared to the barrel 50, the neck 60 has a narrower diameter, and the neck also has a shorter outer periphery than an outer peripheral edge 56 of the lobe 54. Also, the neck 60 axially spaces the cam lobe 54 from the barrel 50 such that the lobe accommodates a thickness of the bladeset bracket 22 as well as a thickness of the stationary blade 18 (FIG. 5).

Figure 9:
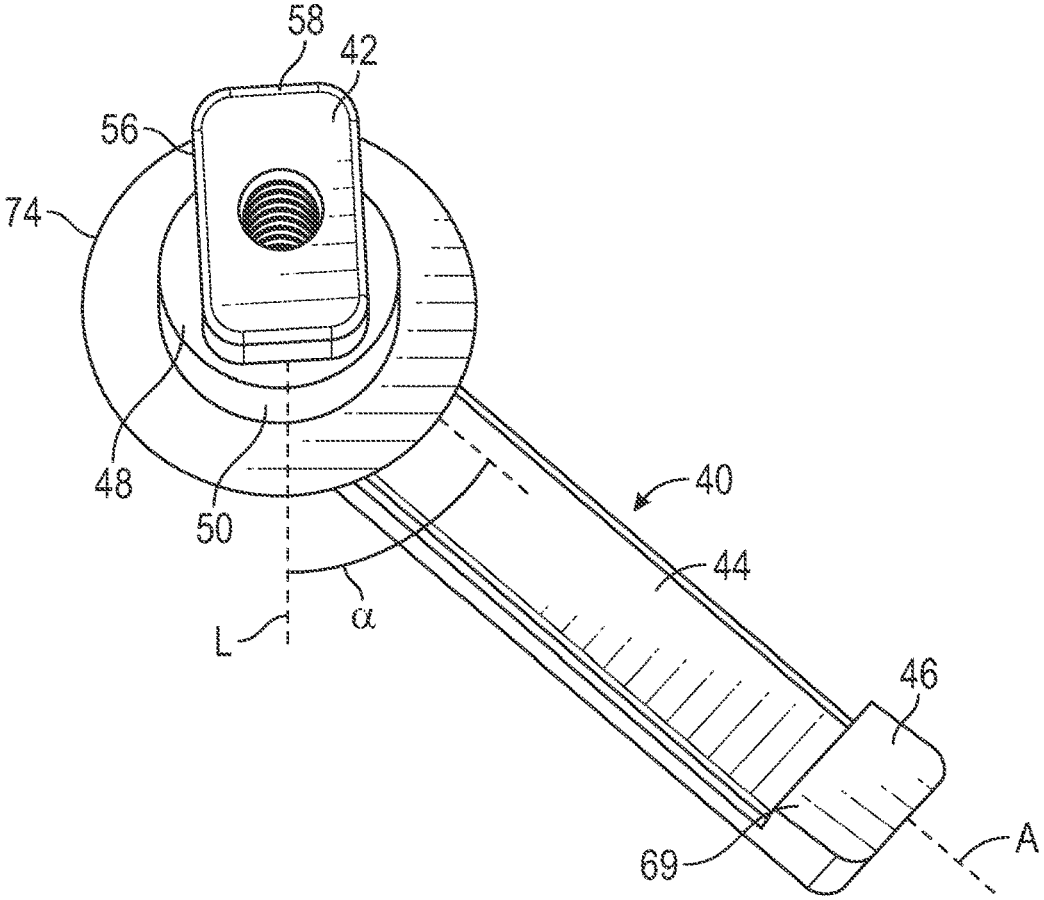
FIG. 9 is a bottom plan view of the lever of FIG. 8.
Figure 10:
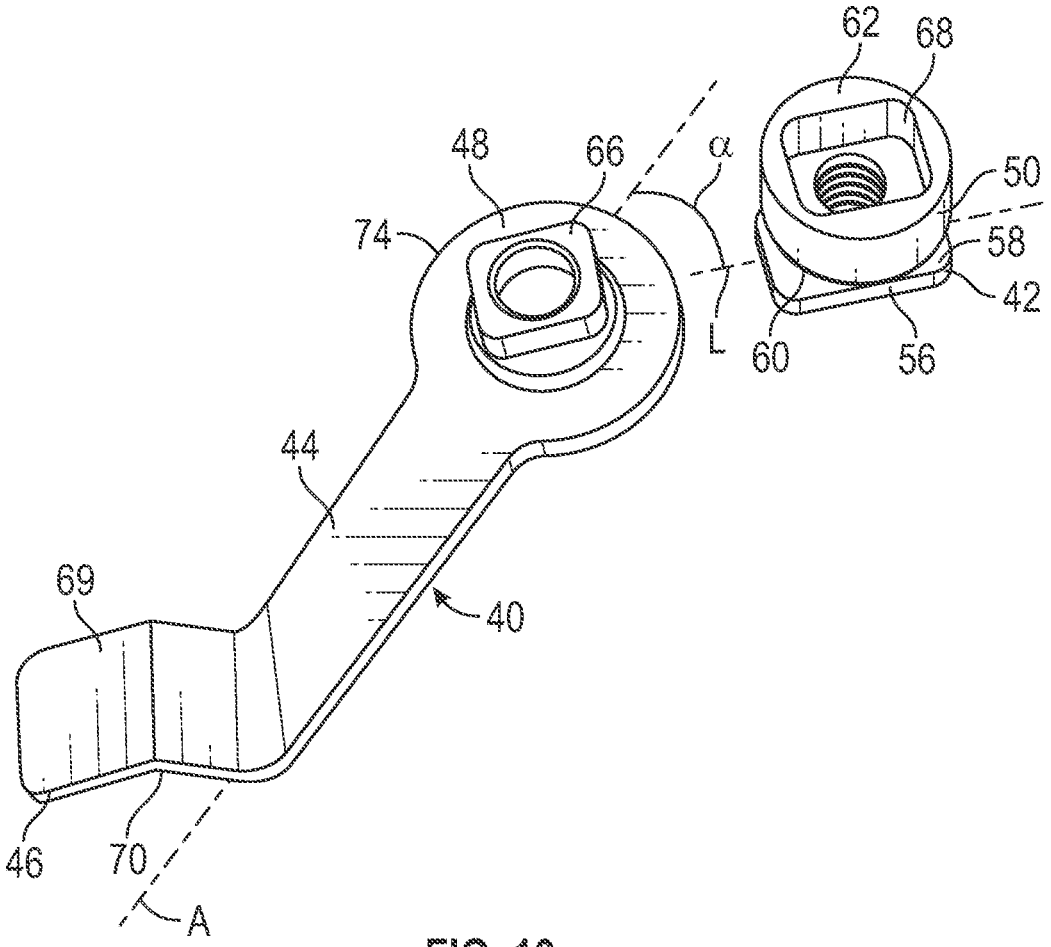
FIG. 10 is an exploded bottom perspective view of the lever of FIG. 8.
Figure 11:
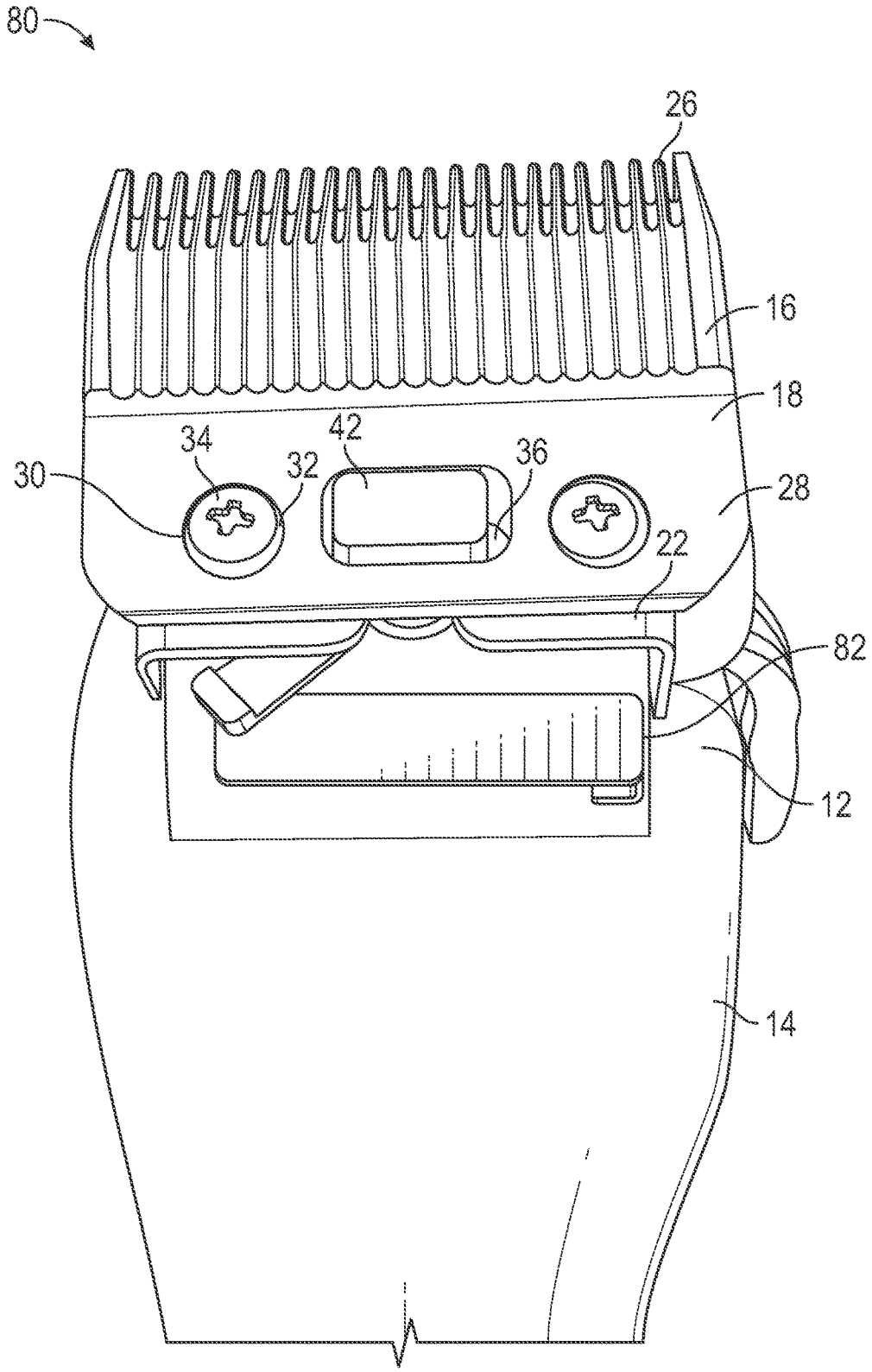
FIG. 11 is a fragmentary bottom view of a hair clipper equipped with a second embodiment of the present apparatus for releasably locking the stationary blade to the hair clipper.
Figure 12B:
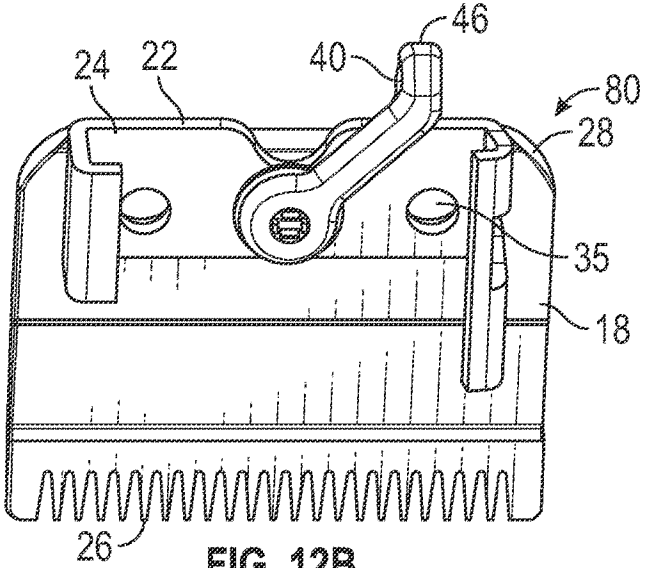
FIG. 12B is a bottom plan view of the stationary blade of FIG. 12A.
Figure 12D:
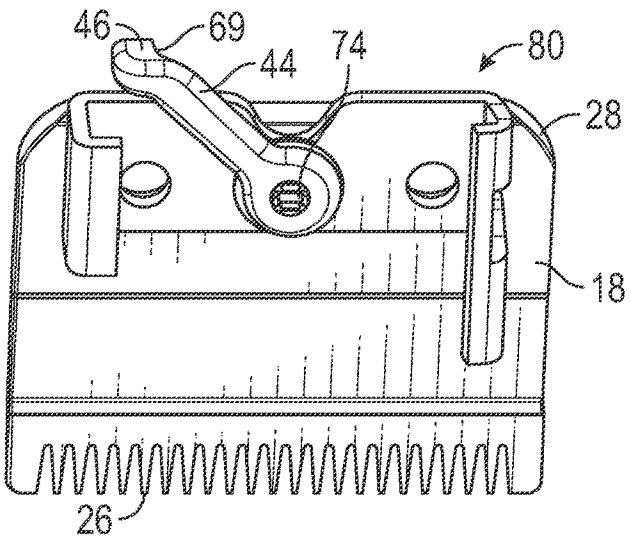
FIG. 12D is a bottom plan view of the stationary blade of FIG. 12C.
Figure 12A:
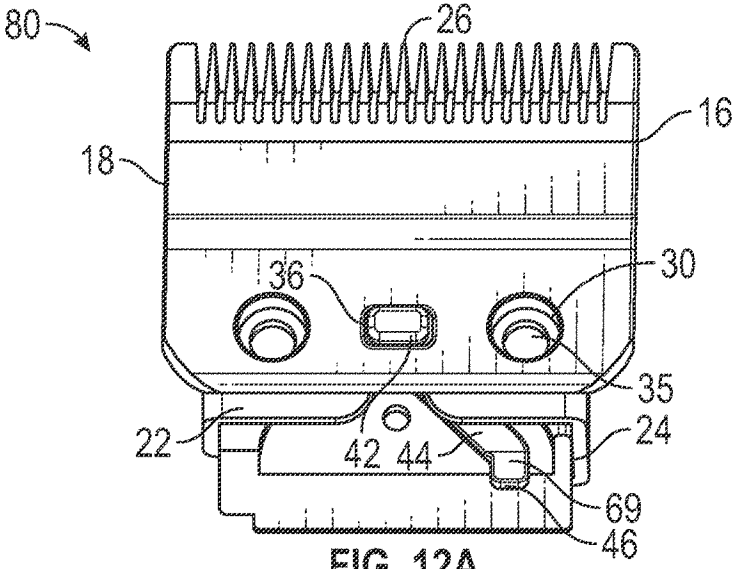
FIG. 12A is a top plan view of the stationary blade with the embodiment of FIG. 11 in the unlocked position.
Figure 12C:
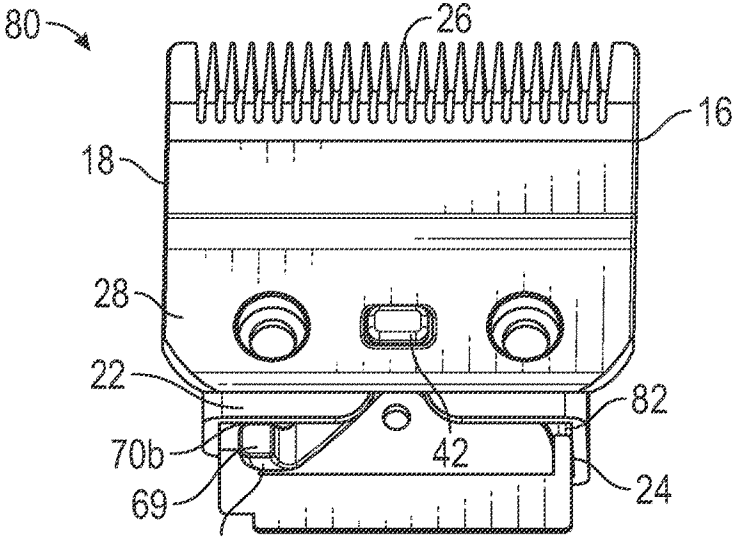
FIG. 12C is a top plan view of the stationary blade with the embodiment of FIG. 11 in the locked position.

Referring now to FIGS. 9 and 10, another feature of the present lever 40 is that the cam lobe 54 has a lobe axis "L" which extends through the opposed ends of the lobe, and the arm 44 has an arm axis "A" which extends through the free end 46 to the pivot end 48 of the arm. Further, the lobe axis "L" is inclined by an angle $\alpha$ relative to the arm axis "A". In the preferred embodiment, the angle $\alpha$ is oblique, and more preferably the angle $\alpha$ is 45 degrees, which may vary to suit the application (FIGS. 9 and 10). The angular orientation of the cam lobe 54 to the arm is maintained through the use of a key formation 66 projecting from the pivot end 48 of the arm 44, which matingly engages a receiving formation 68 on the barrel 50 such that when the lever 40 is assembled, the cam lobe 54 is oriented at the desired angular orientation.

In the preferred embodiment, the key formation 66 is a polygonal projection, and the receiving formation 68 is a complementarily-shaped socket, however the structures may be reversed depending on the application, and the key shape may also vary as needed. Also, the main opening 38 in the bracket 22 accommodates the outer periphery 56 of the cam lobe 54. The cam lobe 54 is inserted through the opening 38 in the bladeset bracket 22 and through the bracket opening 36 in the stationary blade 18 at the second, unlocked position, and the lever 40 is rotated to the first, locked position where said lobe becomes locked, and the blade 18 is held in position on the bracket.

Referring now to FIGS. 2A, 2B, 2C, 2D, and 8-10 another feature of the lever 40 is that at the free end 46, a stop 69 having opposed sides 70, having opposed sides, extends from the arm 44. In the preferred embodiment, the stop 69 extends generally perpendicularly from the arm 44, however other angular orientations are contemplated. In operation, one of the opposed sides 70*a* of the stop 69 is closely adjacent or in contact with the stationary blade 28 when the lever 40 is in either the first, locked position or the second, unlocked position, and another of the opposed sides 70*b* is closely adjacent or in contact with the blade when the lever is in the other of the first, locked position or the second, unlocked position.

Figure 7:
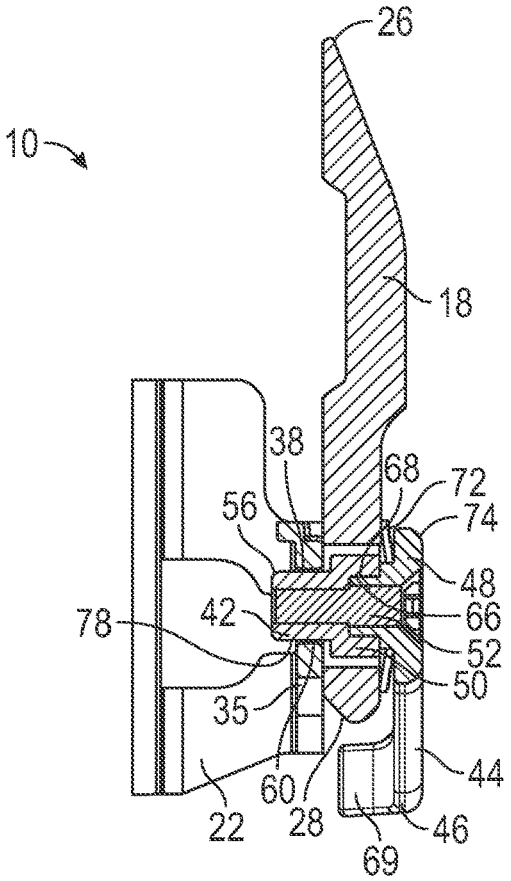
FIG. 7 is a section taken along the line 7-7 of FIG. 6 and in the direction indicated generally.
Figure 8:
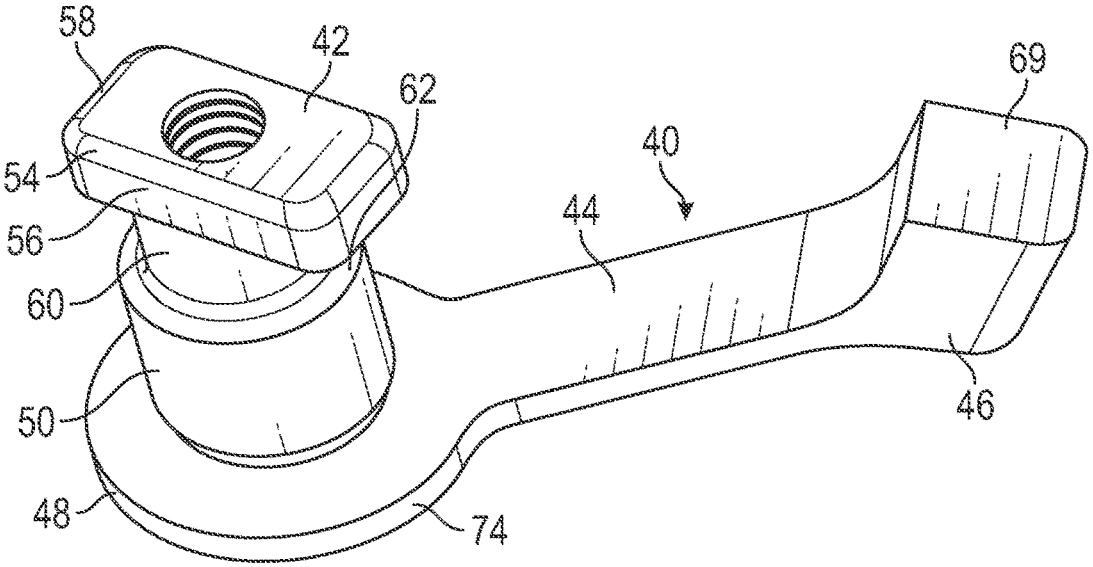
FIG. 8 is a bottom perspective view of the present lever.

Referring now to FIGS. 3, 5 and 7, to enhance the locking action of the lever 40 against the bladeset bracket 22, at least one wave washer or spring washer 72 is provided. The washer 72 slidably engages and circumscribes a periphery of the barrel 50, preferably adjacent a larger diameter head 74 at the pivot end 48. Also, the locking action of the cam lobe 54 is facilitated by the lobe having a sloped shape proximate to the barrel end 62, and the main opening 38 in the bladeset bracket has a chamfered interior edge 78 (FIGS. 5 and 7).

Referring now to FIGS. 11, 12A, 12B, 12C and 12D, an alternate embodiment of the present apparatus 10 is generally designated 80. Components shared with the apparatus 10 are designated with identical reference numbers. A main difference between the apparatus 80 and the previously-described apparatus 10 is that in the latter, the lever 40 is external to the stationary blade 18, while in the former, the lever 40 is held inverted between the blade bracket 22 and the clipper housing 14. An advantage to the apparatus 80 is that the lever 40 is retained to the bladeset bracket 22 in both the locked and unlocked position, by virtue of a gap 82 between the clipper housing 14 and the bladeset bracket. This gap 82 traps the lever 40 in position until the bladeset bracket 22 is removed from the hair clipper 12. In the apparatus 10, when the lever 40 is in the unlocked position, the lever is removable from the bladeset bracket 22 and potentially misplaced by the user.

Another feature of the apparatus 80 is that the locking formation 42 engages the stationary blade 18 and holds it against the bladeset bracket 22. More specifically, the cam lobe 54 presses against the stationary blade 18, whereas in the apparatus 10 the lobe presses against the bladeset bracket 22.

Figure 13:
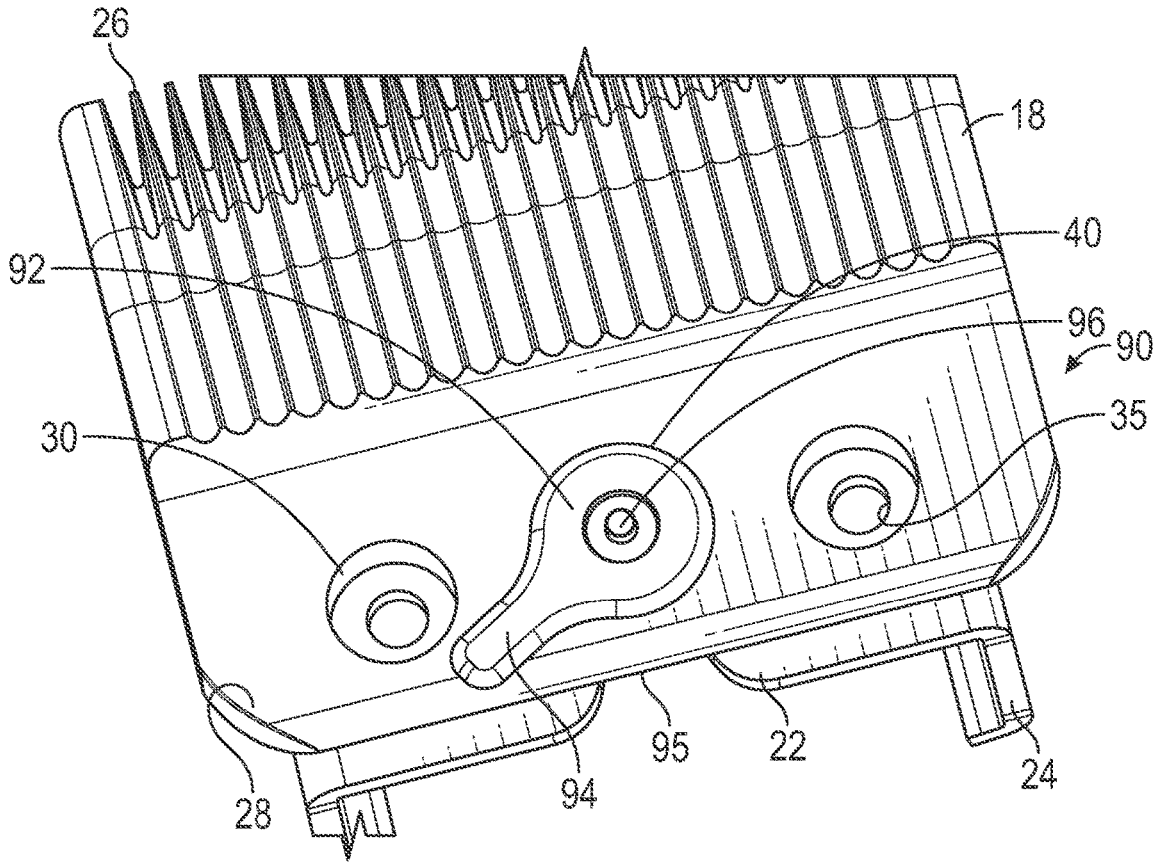
FIG. 13 is a fragmentary top plan view of the stationary blade with another alternate embodiment of the present apparatus.
Figure 14:
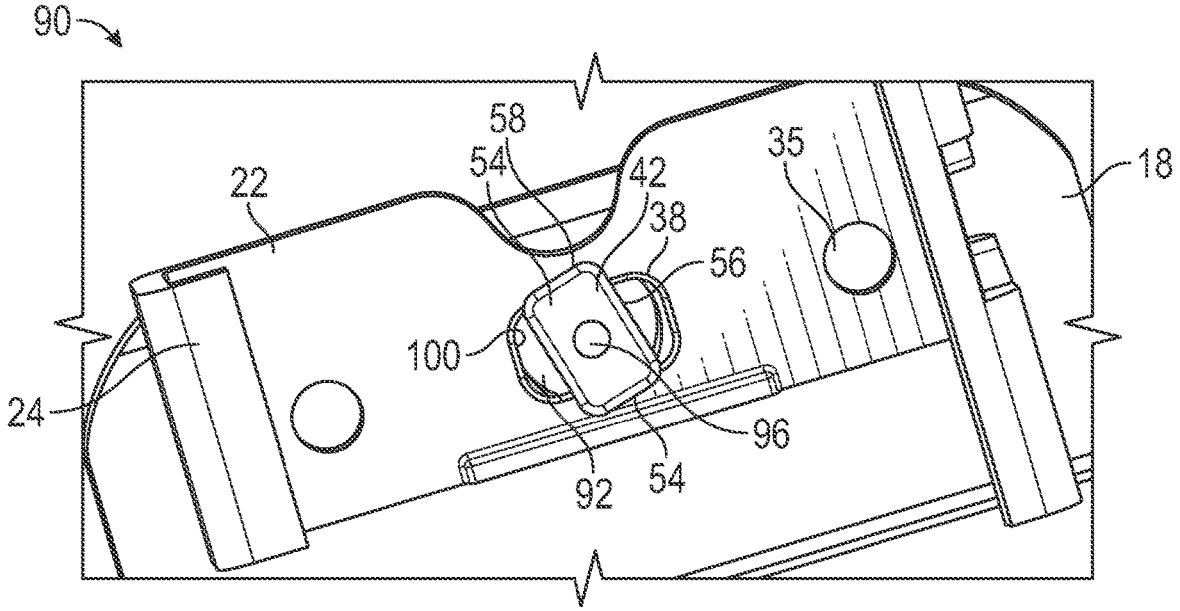
FIG. 14 is a fragmentary bottom view of the apparatus of FIG. 13 in the locked position.
Figure 15:
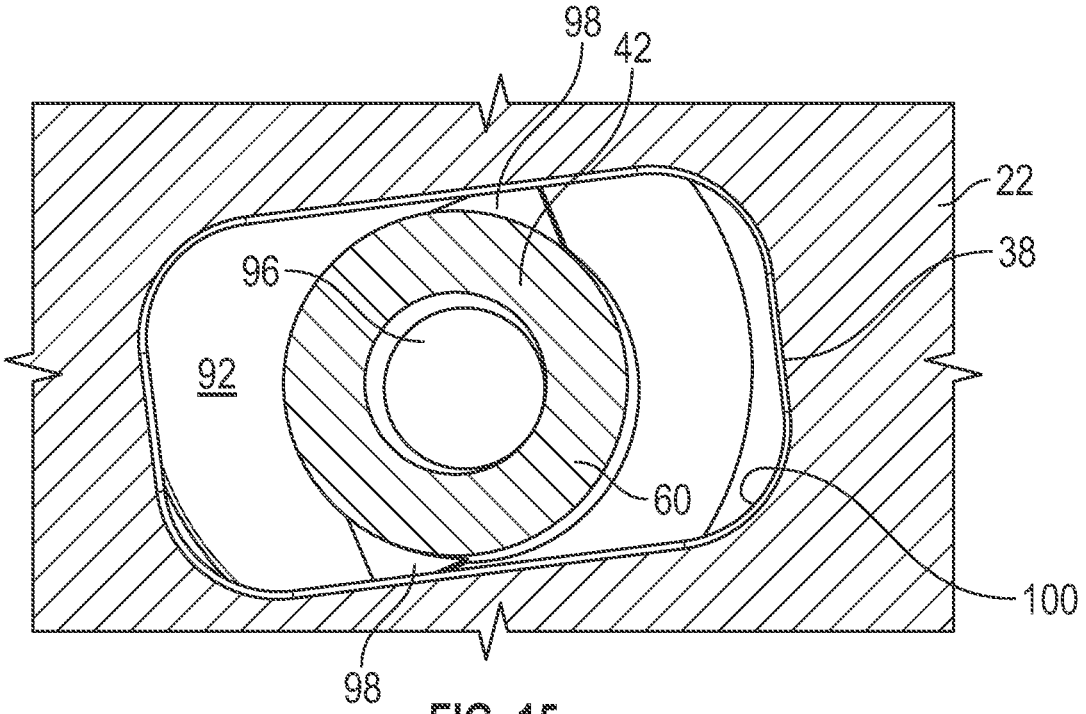
FIG. 15 is a fragmentary horizontal cross-section of the apparatus of FIGS. 13-14 showing locking stops on the locking formation engaging the bracket.

Referring now to FIGS. 13-15, another alternate embodiment of the present apparatus 10 is generally designated 90. Components shared with the apparatus 10 and 80 are designated with identical reference numbers. An important distinguishing feature of the apparatus 90 is that the actuator 40 takes the form of a relatively smaller profile, "paddle"-shaped handle 92. A grip 94 of the handle 92 is dimensioned so as to not extend past a bottom edge 95 of the base 28 of the stationary blade 18 when in the locked position, shown in FIGS. 13 and 14. In other words the grip 94, and more generally the handle 92, are situated within the area bounded by the outer periphery of the stationary blade 18 so as to leave the bottom edge 95 unobstructed by the handle 92. Such a configuration advantageously allows for the use of blade combs, blade guards, and other componentry that are designed to mate with an unobstructed edge such as bottom edge 95.

Referring now to FIGS. 14 and 15, another feature of the apparatus 90 is that the barrel fastener 52 is preferably omitted and replaced with a rivet 96. Still another feature of the apparatus 90 is that, in view of the relatively shorter grip 94, the stop 69 has been removed. Instead, the locking formation 42 is equipped with at least one and preferably a pair of radially outwardly projecting locking stops 98 that frictionally, tightly engage an adjacent interior surface 100 of the main bracket opening 38. The locking stops 98 are dimensioned so that once the grip 94 is in the locked position shown in FIGS. 13 and 14, a tight, wedged relationship is created between the stops and the surface 100 to maintain the locking formation 42 in position during clipper operation. While in the preferred embodiment, the locking stops 98 are generally triangular in shape, and are relatively diametrically opposed on the locking formation 42, it will be appreciated that other orientations are suitable depending on the application.

Figure 16:
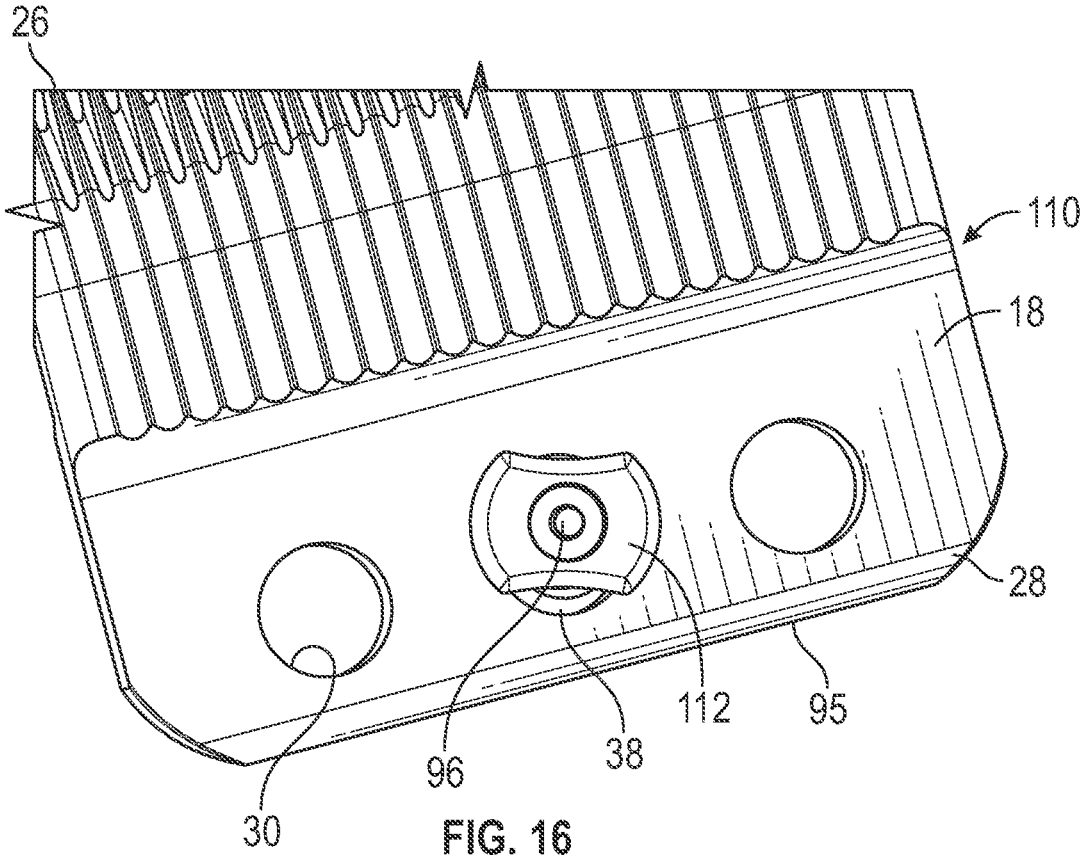
FIG. 16 is a fragmentary top plan view of the stationary bade with still another alternate embodiment of the present apparatus.

Referring now to FIG. 16, still another alternate embodiment of the present apparatus 10 is generally designated 110. Components shared with the embodiments 10, 80 and 90 are designated with identical reference numbers. The embodiment 110 is most closely related to the embodiment 90. Instead of the "paddle"-shaped handle 92, the actuator 40 is provided in the form of a further reduced profile, or "bat-wing" formation 112. As was the case with the grip 92 described in the embodiment of FIGS. 13-15, the formation 112 is dimensioned to not extend past the periphery of the stationary blade base 28. It is contemplated that the formation 112 will be dimensioned to facilitate user manipulation between the locked and unlocked positions described above, without the use of tools. Also, modification of the frictional force generated by the locking stops 98 is envisioned to facilitate user manipulation of the locking member without the use of tools.

While a particular embodiment of the present apparatus for releasably locking a stationary blade to a hair clipper has been described herein, it will be appreciated by those skilled in the art that changes and modifications may be made thereto without departing from the invention in its broader aspects and as set forth in the following claims.

What is claimed:

1. An apparatus for releasably locking a stationary blade to a hair clipper, comprising:

a stationary blade having a bracket opening;

a bracket configured for fixing said stationary blade to said hair clipper, said bracket having a main opening aligned with said bracket opening; and an actuator having a locking formation releasably engaged in said bracket opening and said main opening and rotatable about an axis passing through said bracket opening and said main opening between a first, locked position locking said stationary blade to said bracket, and a second, unlocked position releasing said stationary blade from said bracket, said actuator including an arm with a free end and a pivot end, said pivot end connected to said locking formation, said free end being user actuated between said first and second positions;

wherein upon said actuator being moved between said first and second positions upon engagement in said bracket opening and said main opening, said arm is configured for defining a plane parallel to a plane defined by said stationary blade;

wherein said actuator further comprises:

a barrel proximate to said pivot end and extending from said arm, said barrel having an outer periphery;

said locking formation is a cam proximate to said barrel, comprising:

a lobe with an outer periphery having opposing ends;

a neck connecting said lobe to said barrel, and having an outer periphery smaller than said outer periphery of said lobe, and wherein said lobe is inserted through said main opening in said bracket at said second, unlocked position, and said actuator is rotated to said first, locked position where said actuator becomes locked.

2. The apparatus of claim 1, wherein said actuator further comprises:

a lobe axis which extends through said opposed ends of said lobe; and an arm axis which extends through said free end and said pivot end of said arm, wherein said lobe axis is inclined by an angle $\alpha$ relative to said arm axis.

3. The apparatus of claim 2, wherein said angle $\alpha$ is oblique.

4. The apparatus of claim 2, wherein said angle $\alpha$ is 45 degrees.

5. The apparatus of claim 1, further including a stop, having opposed sides, proximate said free end and extending from said arm.

6. The apparatus of claim 5, wherein one of said opposed sides of said stop is closely adjacent to said bracket when said actuator is in either said first, locked position or said second, unlocked position, and another of said opposed sides is closely adjacent to said bracket when said actuator is in the other of said first, locked position or said second, unlocked position.

7. The apparatus of claim 1, wherein said barrel has at least one wave washer circumscribing an exterior of said barrel.

8. The apparatus of claim 1, further including a securing mechanism extending through said actuator proximate said pivot end that attaches said barrel and said cam to said arm.

9. The apparatus of claim 1, wherein said locking formation has at least one locking stop configured for frictionally engaging said bracket in said locked position.

10. The apparatus of claim 1, wherein said lobe is axially spaced from said barrel, such that said lobe accommodates a thickness of said bracket.

11. The apparatus of claim 1, wherein said main opening of said bracket accommodates said outer periphery of said lobe.

12. The apparatus of claim 1, wherein said stationary blade is affixed to said bracket with locating bushings, said locating bushings being held in place by fasteners.

13. The apparatus of claim 1, wherein said main opening has an inner periphery, said inner periphery has chamfered edges.

14. The apparatus of claim 13, wherein said locking formation further comprises: a lobe having a sloped shape proximate to a barrel end.

15. The apparatus of claim 1, wherein said barrel engages said arm at said pivot end, and said barrel and said pivot end are attached to each other using a keyed structure so that an axis of said lobe extends at a predetermined angle to an axis of said arm.

16. An apparatus for releasably locking a stationary blade to a hair clipper, comprising:

a stationary blade;

a bracket configured for fixing said stationary blade to said hair clipper, said bracket having an opening; and an actuator having a locking formation releasably engaged in said opening and operable between a first, locked position locking said stationary blade to said bracket, and a second, unlocked position releasing said stationary blade from said bracket, said actuator further comprising:

an arm with a free end and a pivot end;

a barrel proximate said pivot end, said barrel extending from said arm and having an outer periphery;

a stop having opposed sides, said stop located proximate said free end and extending from said arm, and wherein one of said opposed sides of said stop is in contact with said bracket when said actuator is in either said first, locked position or said second, unlocked position, and another of said opposed sides is in contact with said bracket when said actuator is in the other of said first, locked position or said second, unlocked position.

17. The apparatus of claim 16, further including:

said locking formation is a cam proximate said barrel, said cam comprising:

a lobe with an outer periphery having opposing ends;

a neck connecting said lobe to said barrel, and having an outer periphery smaller than said outer periphery of said lobe, and wherein said lobe is inserted through said opening in said bracket at said second, unlocked position, and said actuator is rotated to said first, locked position where said actuator becomes locked.

18. The apparatus of claim 16, wherein said stationary blade is affixed to said bracket with locating bushings, said locating bushings being held in place by fasteners.

* * * * *